United States Patent [19]

Barnes

[11] 4,271,769

[45] Jun. 9, 1981

[54] MACHINE FOR PRODUCING A TEXTILE PRODUCT

[75] Inventor: William J. Barnes, Disley, England

[73] Assignee: Newroyd Limited, Oldham, England

[21] Appl. No.: 89,727

[22] Filed: Oct. 31, 1979

[30] Foreign Application Priority Data

Nov. 10, 1978 [GB] United Kingdom ..... 44042/78

[51] Int. Cl.[3] ..... D05C 15/00

[52] U.S. Cl. ..... 112/79 FF; 112/222

[58] Field of Search ..... 112/79 R, 79 FF, 79 A, 112/80, 222, 221

[56] References Cited

U.S. PATENT DOCUMENTS 3,356,047 12/1967 Short ..... 112/79 FF

FOREIGN PATENT DOCUMENTS 1527652 10/1978 United Kingdom ..... 112/79 FF

*Primary Examiner*—Ronald Feldbaum

*Attorney, Agent, or Firm*—Anthony J. Casella

[57] ABSTRACT

A machine for producing a textile product, the machine having a needle provided with a leading end portion which extends non-axially with respect to the main portion of the needle, means for reciprocating the needle, in a predetermined needle reciprocation stroke, into and out of backing material and for effecting relative traversing movement therebetween, and means for ensuring that the leading end portion is inclined away from the direction of the said relative traversing movement throughout the latter, the said leading end portion having an axial length at least as great at the length of the needle reciprocation stroke.

14 Claims, 8 Drawing Figures

MACHINE FOR PRODUCING A TEXTILE PRODUCT

Figure 1:
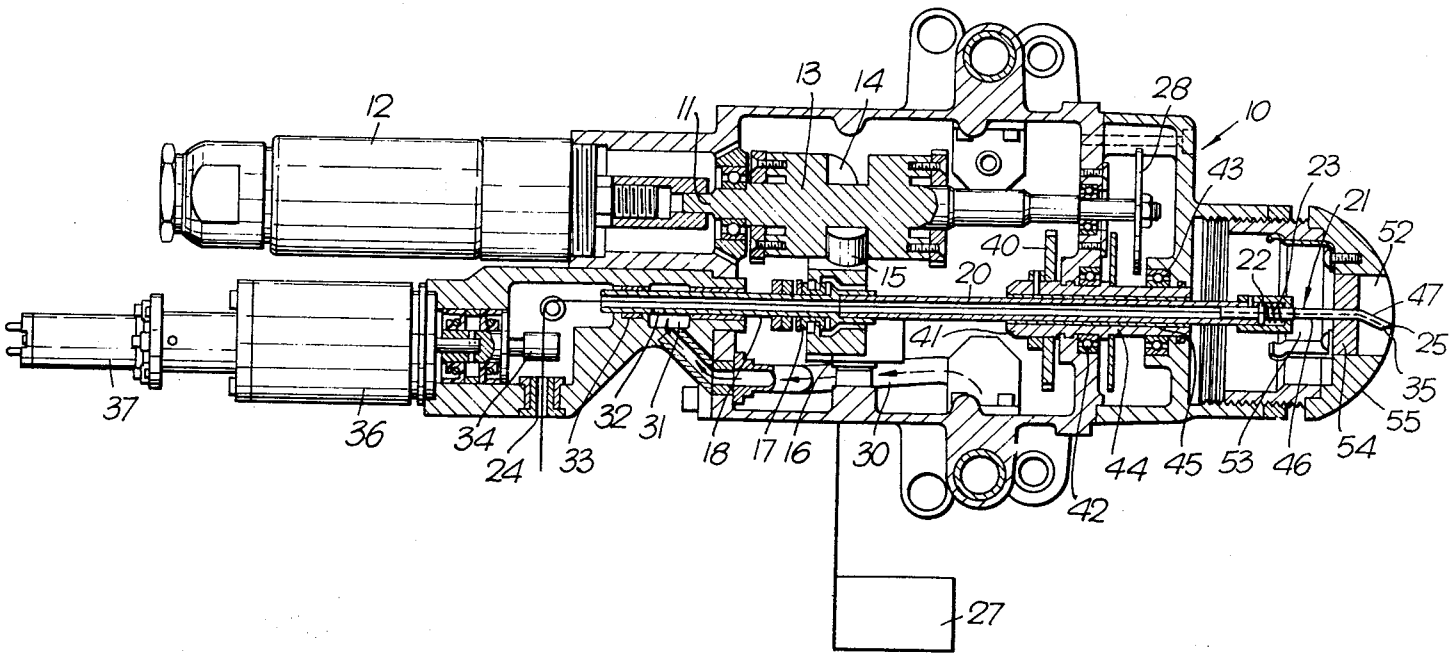

This invention concerns a machine for producing a textile product and, although the invention is not so restricted, it is more particularly concerned with a machine for producing tufted carpets and rugs.

When the needle of a tufting machine penetrates a textile backing sheet during the tufting process, there is continuous relative traversing movement between the needle and the backing sheet in the plane of the latter. Thus the backing sheet may be stationary and the needle may be traversed thereover in various directions, or the axis of the needle may be stationary while the backing sheet is appropriately traversed with respect thereto. The relative traversing movement between the needle and the backing sheet which occurs after the needle has penetrated the latter may be possible either because the backing sheet is extensible or because some deflection of the needle is permitted. However, once the needle, during any particular reciprocation thereof, has penetrated the backing sheet, frictional forces are generated between the needle and the backing sheet, and these forces normally increase substantially to the point in the reciprication at which the needle is withdrawn from the backing sheet. The frictional forces act on the side of the needle which actually engages the backing sheet, and these forces increase with the size of the needle, the stitch or tuft interval (i.e. the distance travelled by the needle during the time that the latter penetrates the backing sheet), the traversing speed, and the speed at which the needle is reciprocated. If the traversing speed and the speed of reciprocation of the needle are much higher than those conventionally employed, the said frictional forces can be sufficient to stop the reciprocation of the needle before it is withdrawn from the backing sheet, in which case the said continuous relative traversing movement results in serious damage to both the backing sheet and the needle.

It might be thought that this problem might be solved by providing a more powerful reciprocating drive mechanism to effect needle reciprocation. However, such a solution would be both costly and inefficient in energy utilisation. Moreover, if the needle and the reciprocating drive mechanism are mounted on a carriage which is traversed by traverse motors in two orthogonal directions over the backing sheet, the provision of such a more powerful reciprocating drive mechanism has the disadvantage of increasing the weight of the carriage. This in turn requires an increase in the power of the traverse motors.

As disclosed in U.S. Pat. Nos. 3,356,047 and 4,015,551, it is known to provide a hollow needle of a tufting machine with an inwardly swaged camming surface which is provided immediately adjacent to the tip of the needle and which enables the needle to be introduced more easily into the backing sheet. This camming surface, however, has been of very limited axial extent so that, throughout a substantial proportion of the travel of the needle through the backing sheet, the backing sheet has been engaged by a purely axially extending surface of the needle, and consequently the frictional forces mentioned above have not been adequately reduced.

In the case of the needle of U.S. Pat. No. 3,356,047, the said camming surface is produced by a swage block such that it is not practicable for the axial length of the camming surface to exceed the axial length of the orifice at the leading end of the needle, since if it did so exceed it, the swage block would reduce the internal cross-section of the needle and thereby restrict the size of the yarn which could be used. Unless, however, the axial length of the camming surface substantially exceeds the axial length of the orifice, the camming surface will not engage the backing sheet throughout the needle reciprocation stroke, with the result mentioned above.

According therefore to the present invention, there is provided a machine for producing a textile product, the machine having a needle provided with a leading end portion which extends non-axially with respect to the main portion of the needle, means for reciprocating the needle, in a predetermined needle reciprocation stroke, into and out of backing material and for effecting relative traversing movement therebetween, and means for ensuring that the leading end portion is inclined away from the direction of the said relative traversing movement throughout the latter, the said leading end portion having an axial length at least as great as the length of the needle reciprocation stroke.

By reason of the fact that, in the case of the present invention, the leading end portion of the needle has an axial length which is at least as great as the length of the needle reciprocation stroke, the frictional forces generated between the side of the needle and the textile material into which the latter is reciprocated in use are substantially reduced, particularly during the portion of the needle reciprocation in which the needle is being withdrawn from the textile material. As a result, the speed of the needle reciprocation and the speed of the said relative traversing movement can be increased without the risk of the needle sticking within the textile material.

Furthermore, as a result of providing a needle with the said leading end portion, there is a reduction in the penetration force required to introduce the needle into the textile material, while at the same time the shape of the needle is such as to increase the space for the yarn connecting with the preceding stitch or tuft.

The needle is preferably a hollow needle having at its leading end an orifice through which textile material, which has been passed through the interior of the needle, may be introduced into the backing material.

The axial length of the leading end portion is preferably at least as great as the sum of the axial length of the said orifice and the bore of the needle at the said orifice.

Preferably, the axial length of the leading end portion is at least twice as great as the axial length of the said orifice.

If desired, the orifice may always be disposed in a plane which is disposed at an angle not exceeding 15° to a plane containing the axis of the main portion of the needle.

The needle preferably has a substantially constant internal cross-section normal to its longitudinal centre line at least throughout the length of the leading end portion.

The leading end and main portions of the needle may be linear, and the included angle therebetween may be in the range 5° to 15°.

Preferably there are means for rotating the needle, whenever the direction of the said relative traversing movement is changed, to ensure that the leading end portion is always inclined away from the said direction and that the needle tip always faces forwardly with respect to the said direction. As explained in our British Patent No. 1,527,652, the provision of such means ensures that the needle does not damage the yarn.

The arrangement may be such that the tip of the needle is always disposed on the axis of rotation of the main portion of the needle in all angular dispositions of the needle. Such an arrangement is desirable in order to control the position at which the needle penetrates the backing sheet. In order to ensure that the tip of the needle is always disposed on the axis of rotation of the main portion of the needle in all angular dispositions of the needle, the main portion of the needle may if desired be mounted eccentrically in a rotatable carrier.

In one embodiment of the present invention, the needle is mounted in a head and is withdrawn wholly into the latter at one end of its reciprocating stroke.

The head may have a recess within which is mounted a rotatable bush having an external surface which merges into that of the head, the bush having a slot through which the needle can be reciprocated. The arrangement may be that, by reason of engagement between the needle and the bush, rotation of the needle effects rotation of the bush. Alternatively, there may be a drive connection between the means for rotating the needle and the bush to rotate the latter.

Preferably, there are means for passing a fluid through the interior of the needle to entrain the textile material therethrough.

Figure 2:
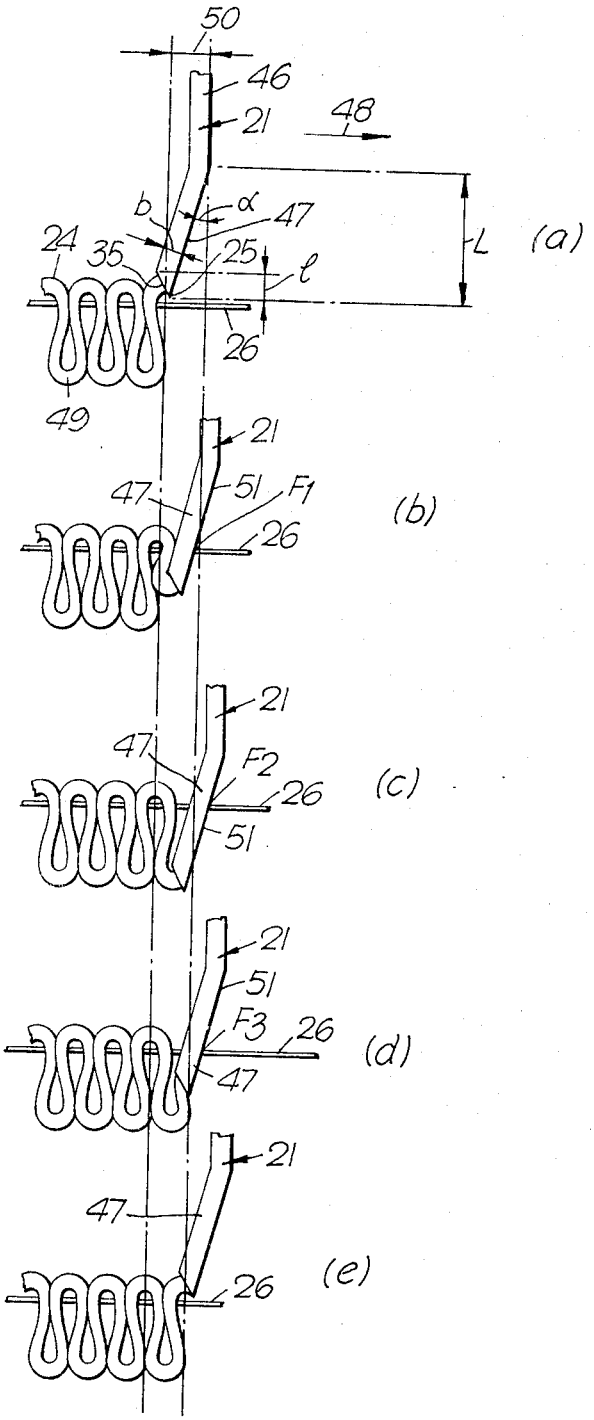
Figure 3:
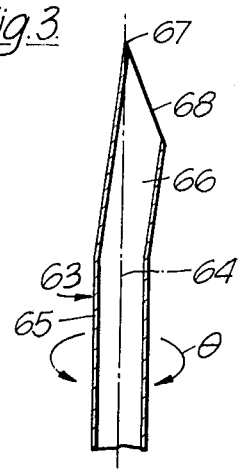
Figure 4:
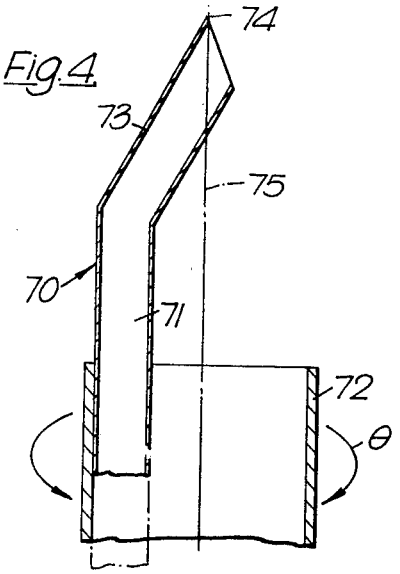
Figure 5:
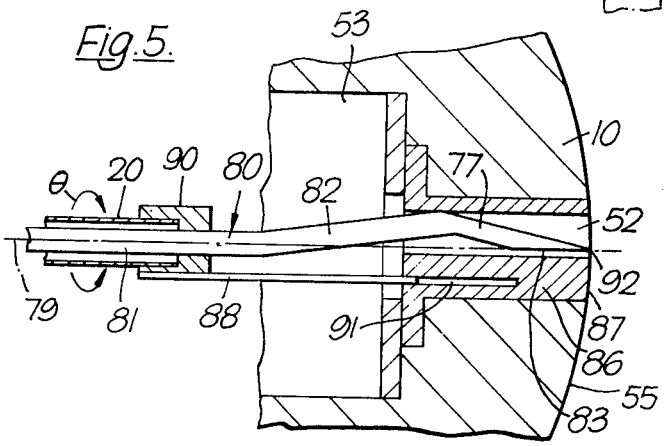
Figure 6:
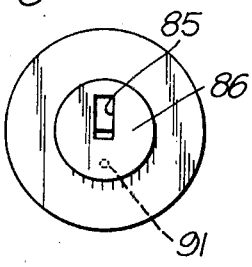
Figure 7:
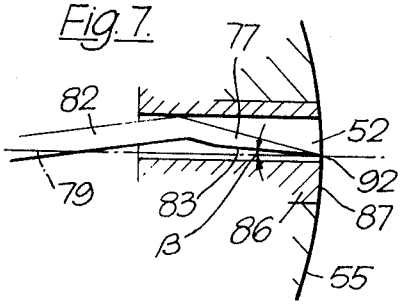
Figure 8:
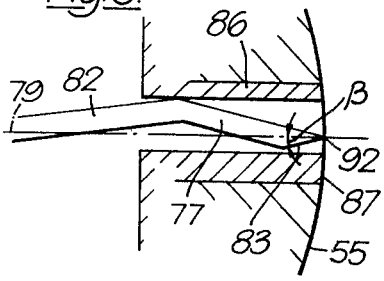

The invention is illustrated, merely by way of example, in the accompanying drawings, in which:

FIG. 1 is a view, partly in section, of a machine according to the present invention for producing a tufted textile product, FIG. 2 is a diagrammatic view illustrating the operation of the needle of the present invention, FIGS. 3 and 4 are broken-away views of alternative embodiments of needles which may be used in the machine shown in FIG. 1, FIG. 5 is a broken-away sectional view of a portion of a modified machine according to the present invention, FIG. 6 is an end view of a bush forming part of the machine of FIG. 5, and FIGS. 7 and 8 illustrate modifications of the structure shown in FIG. 5.

In FIG. 1 there is shown a machine for producing a textile product, e.g. a tufted carpet. The machine comprises a head 10 in which there is rotatably mounted a motor shaft 11. The motor shaft 11 is driven by a compressed air motor 12 and carries a cam 13 having a cam track 14. A cam roller 15 is mounted in the cam track 14 and is carried by a pusher member 16 so that rotation of the motor shaft 11 causes linear reciprocation of the pusher member 16. The pusher member 16 carries a thrust bearing 17 in which is rotatably mounted a hollow shaft 18, the hollow shaft 18 being coaxial with and secured to a hollow needle carrier shaft 20. The trailing end of a hollow needle 21 is mounted in the needle carrier shaft 20. The needle 21 has a substantially constant internal cross-section normal to its longitudinal centre-line throughout the length of the needle and has a flange 22 which is urged by a spring 23 into driving contact with the right hand end of the needle carrier shaft 20. Thus rotation of the motor shaft 11 produces reciprocation of the needle 21 in a predetermined needle reciprocation stroke so that tufting yarn 24 which has been fed, by means described below, to a pointed leading end or tip 25 of the needle may be passed through a textile backing sheet 26 (FIG. 2) to produce tufts therein.

The head 10 is arranged to be traversed over the backing sheet 26 by a traversing device shown diagrammatically at 27, the traversing device 27 comprising two traverse motors (not shown) for respectively traversing the head 10 in orthogonal directions. The traversing device 27 thus effects relative traversing movement between the needle 21 and the backing sheet 26.

The speed of rotation of the motor shaft 11 is sensed by an optical encoder which includes a disc 28, the optical encoder forming part of electronic equipment which provides a method of timing for the whole system. A timing function of this sort is important because of variations in the starting and stopping of the machine, and because use may be made of means (not shown) for varying the needle speed when the direction of travel of the head 10 changes by the large angle. Thus the traverse rate for the said traverse motors and the yarn feed rate may be calculated for a required tuft interval and pile height, and then adjusted for any variation in the needle speed in order to maintain a constant product.

Yarn feed air from a compressed air source (not shown) passes via a conduit 30 to a chamber 31 through which the hollow shaft 18 passes. The wall of the hollow shaft 18 is provided with an aperture 32 therethrough which, when the parts are disposed as shown in FIG. 1, establishes communication between the chamber 31 and the interior of the hollow shaft 18. Thus, in operation, air will pass from the chamber 31 to the interior of the hollow shaft 18 except when, during each reciprocation of the hollow shaft 18, the latter moves to the left of the position shown, when the aperture 32 will be sealed by a bush 33. Thus the air to the interior of the hollow shaft 18 is shut off throughout at least a portion of the time during which the needle 21 does not extend through the backing material 26.

The yarn 24 passes through the nip between a serrated yarn feed roller 34 and another roller (not shown) and thence passes successively through the hollow shafts 18, 20 and through the hollow needle 21, and thus out through an orifice 35 at the leading end of the needle 21, the yarn being in operation propelled through the interior of the needle 21 by the flow of compressed air.

The length, or height, of the yarn per tuft is controlled by a servo-motor 36 and tachometer 37, the servo-motor 36 driving the yarn feed roller 34 and being itself controlled (by the said electronic equipment) so that the yarn feed roller 34 can be driven at a speed such as to produce a controlled continuously variable pile height, a constant pile height, or a pile height changing in steps, whichever is required.

A gear 40 is driven (by means including first and second clutches, not shown) by the shaft 11 and is fixed to a cylindrical member 41 which is rotatably mounted by means of bearings 42, 43. The cylindrical member 41 carries a disc 44 of an optical encoder for determining the angular position of the needle 21, this optical encoder also forming part of the said electronic equipment. The needle carrier shaft 20 has a portion of its outer periphery which is square in cross-section and which extends slidably through a square cross-section sleeve 45, the sleeve 45 being mounted within a square cross-section hole in the cylindrical member 41 and engaging the latter.

The arrangement is such that if the motor shaft 11 is rotated clockwise and the said first clutch (not shown)

is engaged, the needle carrier shaft 20, and hence the needle 21, will also be rotated clockwise, whereas if the motor shaft 11 is rotated clockwise and the said second clutch (not shown) is engaged, the needle 21 will be rotated counter-clockwise.

In operation, therefore, the needle carrier shaft 20 is slidingly reciprocated within the sleeve 45 by virtue of the drive from the cam 13. When, however, appropriate signals from the said electronic equipment are sent to the said first and second clutches, the cylindrical member 41 is rotated through the shortest angular distance to a different angular position and this rotation of the cylindrical member 41 is transmitted to the needle 21 by way of the sleeve 45, whereby to ensure that the needle tip 25 always faces forwardly with respect to the direction in which the needle 21 is being traversed over the backing material 26.

As best shown in FIG. 2, the needle 21 has a main portion 46 and a leading end portion 47, the leading end of the needle having the orifice 35 through which the yarn may be introduced into the backing sheet 26. The axial length L of the leading end portion 47 is at least as great as the length of the needle reciprocation stroke, i.e. the length of penetration of the needle 21 into the backing sheet 26. Moreover, the axial length L of the leading end portion 47 is at least as great as the sum of the axial length l of the orifice 35 and the bore b of the needle 21 at the orifice 35. As a rule, therefore, the axial length L will be made several times as great as, and certainly at least 20% greater than, the axial length l of the orifice 35. The axis of the leading end portion 47 is disposed at an angle $\alpha$ to the axis of the main portion 46, the angle $\alpha$ having a value in the range 5° to 15°.

The above-mentioned electronic equipment ensures that, as the head 10 traverses the needle 21 over the backing sheet 26, the leading end portion 47 is always inclined away from the direction in which the needle is traversed over the backing sheet 26. Accordingly, the above-mentioned electronic equipment ensures that, whenever the direction in which the needle 21 is traversed over the backing sheet 26 is changed, the leading end portion 47 is always inclined away from the direction of traverse. It also ensures that the tip 25 of the needle always faces forwardly with respect to the direction of traverse so that the needle does not damage the yarn, as explained in our British Patent No. 1,527,652 which should also be referred to for a fuller description of the head 10 and the traversing device 27.

FIG. 2 is a diagrammatic representation of the operation of the needle 21 employed in the machine of the present invention. In FIG. 2(*a*) the needle 21 is shown in its bottom dead-centre (B.D.C.) position in which the needle tip 25 is disposed immediately above the textile backing sheet 26. The yarn 24 has been fed through the hollow interior of the needle 21, and the needle 21 has been reciprocated into and out of the backing sheet 26 and has been traversed thereover in the direction of arrow 48 so as to form a plurality of tufts 49 therein which are separated from each other by tuft intervals 50.

In the FIG. 2(*b*) position, the needle 21 is shown as having entered the backing sheet 26 and as having been traversed in the direction of the arrow 48. As a result, a hole will be formed by the needle 21 in the backing sheet 26, and the backing sheet 26 will bear strongly against the inclined surface 51 of the leading end portion 47. Consequently a frictional force $F_1$ will be generated between the surface 51 and the backing sheet 26. However, this frictional force $F_1$ is smaller than it would otherwise be by reason of the inclination of the surface 51.

Further downward movement of the needle 21 brings the latter to its top dead centre (T.D.C.) position shown at FIG. 2(*c*). In this case a frictional force $F_2$ is generated between the backing sheet 26 and the inclined surface 51, and this frictional force $F_2$ is substantially greater than the frictional force $F_1$ since the hole produced by the needle 21 in the backing sheet 26 is substantially greater in the FIG. 2(*c*) position than in the FIG. 2(*b*) position.

The needle 21 now starts to be withdrawn from the backing sheet 26 and passes to the FIG. 2(*d*) position. In this position, a frictional force $F_3$ is generated between the backing sheet 26 and the inclined surface 51 and this force $F_3$ is lower than the force $F_2$ generated at position 2(*c*) because, due to the inclination of the surface 51, the hole produced in the backing sheet 26 in the FIG. 2(*d*) position is smaller than the hole produced in the backing sheet 26 in the FIG. 2(*c*) position.

Finally the needle 21 is withdrawn to its B.D.C. position shown in FIG. 2(*e*) and it will be noted that, due to the provision of the inclined surface 51, the hole produced by the needle 21 in the backing sheet 26 is not increased in size as a result of the traversing of the needle from the FIG. 2(*d*) to the FIG. 2(*e*) position.

Thus as illustrated in FIG. 2, in the case of the needle 21 employed in the present invention the frictional force increases up to the top dead centre position shown at FIG. 2(*c*) and thereafter decreases, whereas if the needle 21 were straight throughout its length the frictional force would increase steadily from the time that the needle was introduced into the backing sheet 26 to the time at which it was withdrawn therefrom. The provision of the needle 21 with an inclined leading end portion 47 which is at least as great as the length of the needle reciprocation stroke ensures that, throughout the time that the needle 21 penetrates the backing sheet 26, the latter contacts the inclined surface 51.

Not only does this mean that the frictional force which is generated between the backing sheet 26 and the needle 21 is reduced, because the needle is in effect introduced into and withdrawn from the backing sheet at an angle, but also it means that this frictional force is at a maximum at the top dead centre position of the needle 21 when the axial speed of the needle 21 is least. The risk therefore of the needle 21 breaking or being stopped, or of the backing sheet 26 being damaged, is substantially less than in the case of the prior art in which the frictional force is at its maximum when the needle is being withdrawn from the backing sheet and thus is at a very high value at the position 2(*d*) where the axial speed of the needle 21 is at its greatest.

Similarly, if a needle of the kind shown in U.S. Pat. No. 3,356,047 were to be employed, movement of the needle between the positions shown in FIGS. 2(*b*) and 2(*d*) would involve engagement between the backing sheet and a purely axially extending portion of the needle, with the result that substantially greater frictional forces would be generated than in the case of the present invention.

Moreover, as perhaps best shown in FIG. 2(*c*), the inclination of the leading end portion 47 of the needle 21 increases the space for the yarn of the currently-formed loop.

The head 10 has an aperture 52 therein, which extends from the periphery of the head 10 to a recess 53 in the latter. The main portion 46 of the needle 21 is rotatably mounted in a needle support bearing 54. When the needle 21 is in its bottom dead centre position shown in FIG. 1, the needle is withdrawn wholly into the aperture 52, and thus inwardly of a curved external surface 55 of the head 10 which presses against the backing sheet 26 during tufting.

In FIGS. 3 to 6 there are illustrated portions of modified embodiments of the present invention which are generally similar to that illustrated in FIG. 1 and which for this reason will not be described in detail.

However, in the FIG. 3 embodiment, the hollow needle 21 is replaced by a hollow needle 63 which is rotatable about the axis 64 of its main portion 65, the main portion 65 being mounted for rotation about the axis 64. The needle 63 has a substantially constant internal cross-section normal to its longitudinal centre line throughout the length of the needle, the needle 63 having at the leading end of the needle an orifice 68. The needle 63 has a non-axially extending leading end portion whose axial length is several times that of the orifice 68, and whose tip 67 is always disposed on the axis 64 of the main portion 65 in all angular dispositions of the needle 63. Thus when the needle 63 is rotated through an angle $\theta$, the tip 67 will remain on the axis 64 and consequently all tufts will be positioned consistently in relation to the needle axis 64.

A similar arrangement is shown in FIG. 4 in which a hollow needle 70 is employed having a main portion 71 which is mounted eccentrically in a rotatable carrier 72. The needle 70 has a non-axially extending leading end portion 73 whose tip 74 is always disposed on the axis of rotation 75 of the rotatable carrier 72, and thus is always disposed on the axis of rotation of the main portion 71. The arrangement shown in FIG. 4 permits the leading end portion 73 to be disposed at a relatively large angle, e.g. 30°, to the main portion 71 of the needle.

In the embodiment of FIGS. 5 and 6, a non-axially extending leading end portion 77 of a hollow needle 80 is connected to a main portion 81 of the needle by a non-axially extending portion 82, while, at the leading end of the needle, there is an orifice 83 which is always disposed in a plane which contains the axis 79 of the main portion 81.

The portion 82 of the needle 80 extends through and is supported by a slot 85 in a needle enclosing bush 86 which is rotatably mounted in the aperture 52 in replacement for the needle support bearing 54 of FIG. 1, the portion 82 being reciprocable in the slot 85. The bush 86 has a curved external surface 87 which merges into the external surface 55 of the head 10.

The bush 86 is caused to rotate through the same angle $\theta$ as the needle carrier shaft 20 either by the engagement between the needle 80 and the walls of the slot 85 or by a driving pin 88 one end of which is secured to a connector member 90 secured to the shaft 20 and the other end of which is slidably mounted in a hole 91 in the bush 86, the hole 91 being of sufficient depth to allow the reciprocation of the driving pin 88.

In the construction of FIGS. 5 and 6, the needle tip 92 is always on the axis 79 of the main portion 81 of the needle 80 and thus of the needle carrier shaft 20. Thus, as will be seen from FIG. 5, irrespective of the angular position of the needle 80, when the needle 80 is in its B.D.C. position, the needle orifice 83 fits as closely as possible within the surface 87 so as to prevent yarn movement out of the needle when the needle is withdrawn behind the textile material. The bush 86 thus restricts yarn movement at B.D.C.

The arrangement shown in FIGS. 5 and 6, in addition to the advantages mentioned above, give improved penetration performance, allows a closer tuft interval, and gives improved yarn control when the needle is withdrawn behind the fabric.

A needle of the sort shown in FIG. 5 could be used on a multi-needle conventional tufting machine with the advantages listed above. In this case there would not be a needle rotation feature, so that a fixed yarn control plate could be used to perform the same function as that of the bush 86.

As shown in FIGS. 7 and 8, the orifice 83 is not necessarily always disposed in the plane which contains the axis 79 of the main portion 81 but may be at an angle $\beta$ thereto, $\beta$ having, for example, a value of up to 15°.

I claim:

1. A machine for producing a textile product, the machine having a needle provided with a leading end portion which extends non-axially with respect to the main portion of the needle, means for reciprocating the needle, in a predetermined needle reciprocation stroke, into and out of backing material and for effecting relative traversing movement therebetween, and means for ensuring that the leading end portion is inclined away from the direction of the said relative traversing movement throughout the latter, the said leading end portion having an axial length at least as great as the length of the needle reciprocation stroke.

2. A machine as claimed in claim 1 which there are means for rotating the needle, whenever the said direction is changed, to ensure that the leading end portion is always inclined away from the said direction and that the needle tip always faces forwardly with respect to the said direction.

3. A machine as claimed in claim 1 in which the needle is a hollow needle having at its leading end an orifice through which textile material, which has been passed through the interior of the needle, may be introduced into the backing material.

4. A machine as claimed in claim 3 in which the axial length of the leading end portion is at least as great as the sum of the axial length of the said orifice and the bore of the needle at the said orifice.

5. A machine as claimed in claim 3 in which the axial length of the leading end portion is at least twice as great as the axial length of the said orifice.

6. A machine as claimed in claim 3 in which the orifice is always disposed in a plane which is disposed at an angle not exceeding 15° to a plane containing the axis of the main portion of the needle.

7. A machine as claimed in claim 1 in which the needle has a substantially constant internal cross-section normal to its longitudinal centre line at least throughout the length of the leading end portion.

8. A machine as claimed in claim 1 in which the leading end and main portions of the needle are linear and the included angle therebetween is in the range 5° to 15°.

9. A machine as claimed in claim 1 in which the main portion of the needle is mounted eccentrically in a rotatable carrier.

10. A machine as claimed in claim 1 in which the needle is mounted in a head and is withdrawn wholly into the latter at one end of its reciprocating stroke.

11. A machine as claimed in claim 10 in which the head has a recess within which is mounted a rotatable bush having an external surface which merges into that of the head, the bush having a slot through which the needle can be reciprocated.

12. A machine as claimed in claim 11 in which, by reason of engagement between the needle and the bush, rotation of the needle effects rotation of the bush.

13. A machine as claimed in claim 11 in which there is a drive connection between the means for rotating the needle and the bush to rotate the latter.

14. A machine as claimed in claims 3 in which there are means for passing a fluid through the interior of the needle to entrain the textile material therethrough.

* * * * *